United States Patent [19]

Lorenz

[11] Patent Number: 4,558,764

[45] Date of Patent: Dec. 17, 1985

[54] SCAFFOLDING SYSTEM

[76] Inventor: Robert A. Lorenz, 1730 Elmdale Ave., Glenview, Ill. 60025

[21] Appl. No.: 661,129

[22] Filed: Oct. 15, 1984

[51] Int. Cl.[4] ..... E04G 3/12; E04G 3/10

[52] U.S. Cl. ..... 182/45; 182/20; 182/36; 182/150

[58] Field of Search ..... 182/150, 45, 36, 38, 182/12, 13, 14; 248/237

[56] References Cited

U.S. PATENT DOCUMENTS

| | | | |
|---|---|---|---|
| 677,645 | 7/1901 | Elkins | 182/45 |
| 884,813 | 4/1908 | Gordnier | 182/150 |
| 1,650,324 | 11/1927 | Campbell | 182/45 |
| 1,816,514 | 7/1931 | Bottoms | 182/112 |
| 2,308,142 | 1/1943 | Alloway | 182/150 |
| 2,426,825 | 9/1947 | Geary | 182/147 |
| 3,011,587 | 12/1961 | Mallog | 182/150 |
| 3,158,223 | 11/1964 | Brown | 182/150 |
| 3,159,243 | 12/1964 | Leonard | 182/150 |
| 3,391,757 | 7/1968 | Duke | 182/150 |
| 3,767,010 | 10/1973 | Newlan | 182/150 |
| 4,074,792 | 2/1978 | Zaugg | 182/150 |
| 4,232,759 | 11/1980 | Jacobs | 182/45 |
| 4,273,214 | 6/1981 | Grove | 182/13 |

*Primary Examiner*—Reinaldo P. Machado
*Attorney, Agent, or Firm*—Richard L. Miller

[57] ABSTRACT

A scaffolding system useable on either a flat or pitched gable roof a roof and including a mast, rollers which connect the mast to the roof, and a winch for adjusting the position of the scaffolding system relative to the roof.

7 Claims, 5 Drawing Figures

SCAFFOLDING SYSTEM

BACKGROUND OF THE INVENTION

The present invention relates to a scaffolding system utilized by roofers and carpenters.

Scaffolding systems of the above mentioned general type are known in the art. For example, U.S. Pat. Nos. 1,650,324; 1,816,514; 2,426,825.

Scaffolding systems are used by roofers, carpenters, and aluminum soffitgutter installers. Carpenters must contend with buildings of variable heights while roofers contend with roofs of variable pitch.

SUMMARY OF THE INVENTION

Accordingly, it is the primary object of the present invention to provide a scaffolding system which avoids the disadvantages of the prior art.

It is another object of the present invention to provide a scaffolding system which is light weight, requires little set up time by one man, and is sturdy. It is still another object of the present invention to provide a scaffolding system which spans long areas, has wider walking-working area, unlimited versatile working height, and will not damage the newly applied roof.

Yet still another object of the present invention is to provide a scaffolding system with ease of up and down movement containing compact access panels and whose vertical members break down to six foot lengths.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
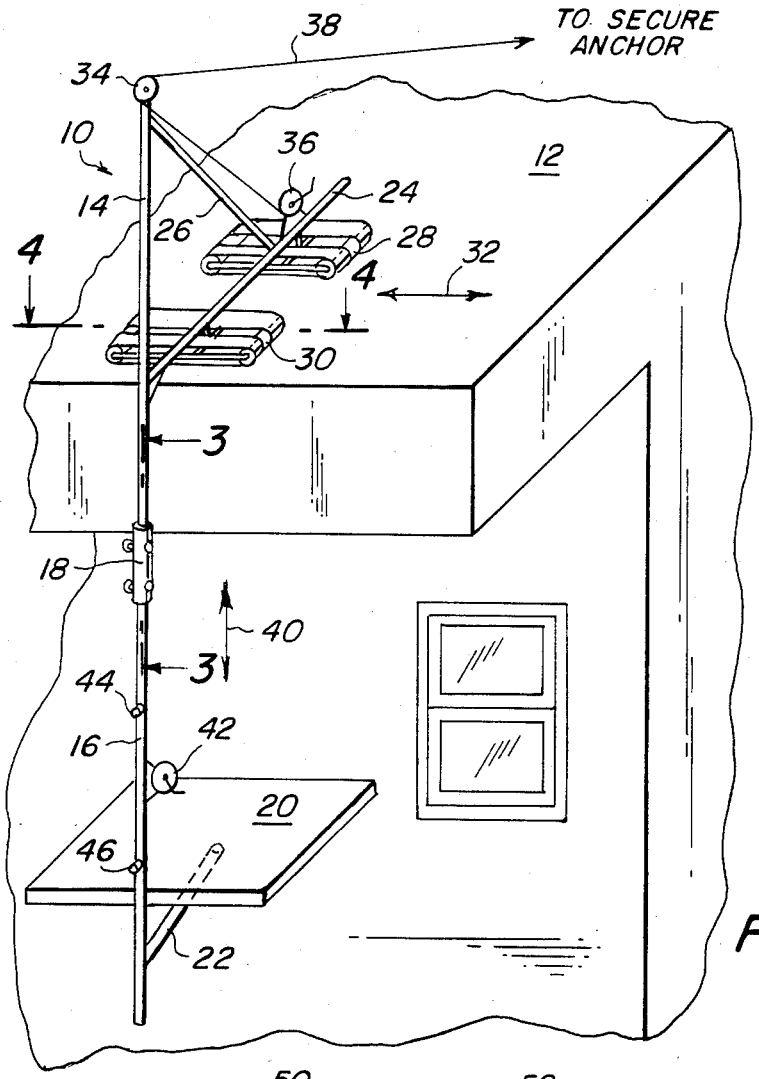
FIG. 1 is a perspective view of first embodiment of the invention illustrated in use on a building.

Referring now to FIG. 1, the scaffolding system of the present invention is shown generally at 10 used on flatroof 12. The scaffolding system 10 consists of an upper mast 14 coupled to a lower mast 16 via a sleeve 18. Attached to the lower mast 16 is a horizontal platform 20 supported by a diagonal brace 22. Projecting from the upper mast 14 is a horizontal rod 24 supported by a second diagonal brace 26. Attached to the horizontal rod 24 are a pair of rollers 28 and 30, both moveable in the direction of arrows 32 on the flatroof 12. A pulley 34 is mounted to the free end of the upper mast 14. A winch 36 is mounted to the horizontal rod 24 opposite the side to which the rollers 28 and 30 are mounted. A cable 38 originates around the winch 36, passes around the pulley 34 and terminates at a secure anchor. The cable 38 is tied off for safety to the other side of the flatroof 12 or a vent stack. The scaffolding system 10 is also vertically adjustable in the direction of arrows 40 by use of the sleeve 18 whose internal diameters is greater than the external diameters of the lower mast 16 and the upper mast 14. A second winch 42 is mounted to the lower mast 16. Projecting perpendicularly from the lower mast 16 are pin mounts 44 and 46 which are used to mount the rollers 28 and 30 when used on a gabled roof.

Figure 2:
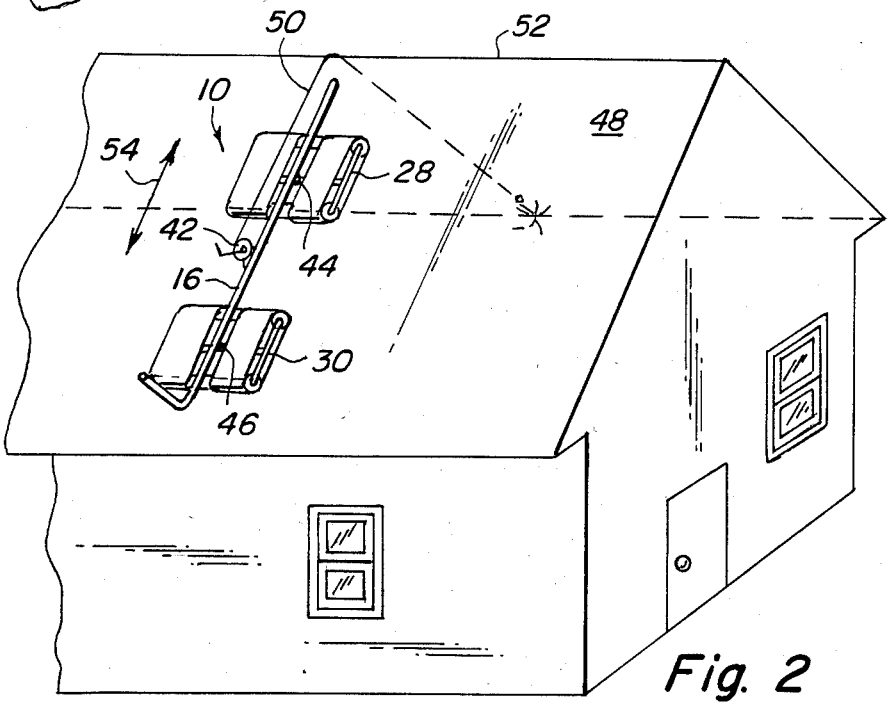
FIG. 2 is a perspective view of a second embodiment of the invention illustrated in use on the roof of a house.
Figure 5:
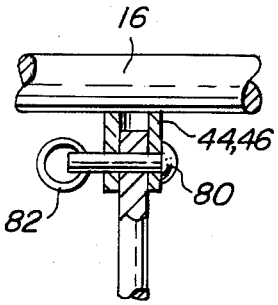
FIG. 5 is an enlarged cross sectional view of a typical structure to couple the rollers to the scaffolding system.

The scaffolding system 10 is shown in FIG. 2 being utilized on a gabled roof 48. Rollers 28 and 30 are mounted to the lower mast 16 via pin mounts 44 and 46 respectively. Cable 50 originates at the winch 42 which is mounted to the lower mast 16 on the side opposite to that to which are mounted the rollers 28 and 30. Cable 50 then passes over roof ridge 52 and is anchored on the other side. By operating the winch 42 the scaffolding system 10 may move in the direction of arrows 54.

Figure 3:
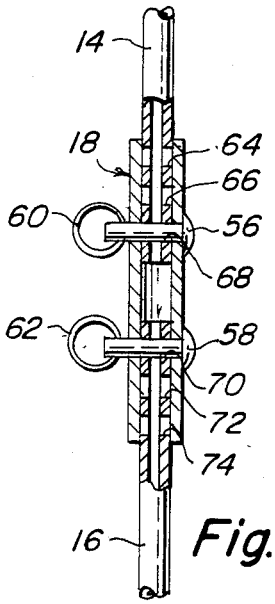
FIG. 3 is an enlarged cross sectional view of coupling member taken on line 3—3 in FIG. 1.

The sleeve 18 is shown in FIG. 3 with the upper mast 14 and the lower mast 16 rigidly secured in place by pins 56 and 58. The pins 56 and 58 are prevented from dislodging by use of locking rings 60 and 62 respectively fitted to their free ends. The variable vertical height of the scaffolding system 10 is achieved by fitting pin 56 into any one of holes 64,66,68, disposed in upper mast 14 and by fitting pin 58 into any one of holes 70,72,74, disposed in lower mast 16.

Figure 4:
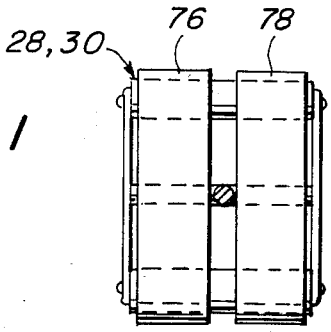
FIG. 4 is a view of a typical tractor device taken on line 4—4 in FIG. 1.

The roller 28 or 30 is shown in FIG. 4 containing rubber non-marring belts 76 and 78.

The rollers 28,30 are attached to the lower mast 16 via the pin mounts 44,46 by use of a pin 80 and locking ring as shown in FIG. 82. Pins 56,58 and 80 are removably mounted from their respectively holes and are rigidly secured therein and prevent their respective member from rotating.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A scaffolding system for use on a roof, comprising:

a lower mast section, an upper mast section, and a sleeve selectively interconnecting said upper and lower mast sections in a coaxial arrangement;

a platform laterally supported by the lower mast section;

a support arm laterally projecting from the upper mast section;

a pair of roller members;

coupling means respectively on said lower mast section and on said support arm for selectively coupling to said pair of roller members;

a first winch means coupled to the lower mast section for controlling a first cable extendable parallel to said lower mast section, and a second winch means coupled to the support arm for controlling a second cable extendable perpendicular to the upper mast section, whereby with said roller members coupled to said lower mast section, said scaffolding system can be utilized on a gabled roof with the end of the first cable extending over the top ridge of the roof and anchored on the other side of the roof and said first winch means controlling the movement up and down along the gabled roof, and with said roller members coupled to said support arm and said lower and upper mast sections interconnected, said scaffolding system can be utilized on a flat roof with the end of the second cable extending along the flat roof and anchored at a remote location and said second winch means controlling the movement across the flat roof.

2. The scaffolding system as defined in claim 1, wherein the upper and lower mast sections contained a plurality of throughbores.

3. The scaffolding system as defined in claim 2, wherein said sleeve has a plurality of first pins that are received by said plurality of throughbores so that said mast is vertically adjustable.

4. The scaffolding system as defined in claim 1, wherein said roller members includes roller belts.

5. The scaffolding system as defined in claim 1, wherein said coupling means comprises mounts onto which said roller members are removably mounted.

6. The scaffolding system as defined in claim 3, wherein said plurality of first pins are removably mounted and have free ends onto which are mounted removable locking rings.

7. The scaffolding system as defined in claim 5, further comprising second pins for removably mounting said roller members to said mounts, said second pins having free ends onto which are mounted locking rings.

* * * * *